US006886259B2

(12) United States Patent
Kani

(10) Patent No.: US 6,886,259 B2
(45) Date of Patent: May 3, 2005

(54) CIRCULAR SAW WITH IMPROVED CUTTING DEPTH ADJUSTMENT

(75) Inventor: Toshiyuki Kani, Okazaki (JP)

(73) Assignee: Makita Corporation, Anjo (JP)

( * ) Notice: Subject to any disclaimer, the term of this patent is extended or adjusted under 35 U.S.C. 154(b) by 77 days.

(21) Appl. No.: 10/211,212

(22) Filed: Aug. 2, 2002

(65) Prior Publication Data

US 2003/0024128 A1 Feb. 6, 2003

(30) Foreign Application Priority Data

Aug. 2, 2001 (JP) ..... 2001-235411

(51) Int. Cl.[7] ..... B27B 9/02
(52) U.S. Cl. ..... 30/376; 30/390
(58) Field of Search ..... 30/375, 376, 377, 30/390, 391

(56) References Cited

U.S. PATENT DOCUMENTS

| | | | | |
|---|---|---|---|---|
| 3,262,472 A | | 7/1966 | McCarty et al. | 143/43 |
| 3,722,496 A | | 3/1973 | Schuman | 125/13 |
| 4,856,394 A | | 8/1989 | Clowers | 83/56 |
| 4,982,501 A | * | 1/1991 | Sauerwein et al. | 30/376 |
| 5,136,910 A | * | 8/1992 | Kuhn et al. | 83/863 |
| 5,381,602 A | | 1/1995 | Matzo et al. | 30/377 |
| 5,570,511 A | | 11/1996 | Reich et al. | 30/376 |
| 6,301,790 B1 | * | 10/2001 | Zeiler et al. | 30/391 |
| 6,375,557 B1 | | 4/2002 | Spangenberg et al. | 451/344 |
| 6,601,305 B1 | * | 8/2003 | Fukuoka | 30/376 |

FOREIGN PATENT DOCUMENTS

| | | |
|---|---|---|
| DE | 43 08 598 C1 | 2/1994 |
| DE | 44 03 189 A1 | 8/1995 |
| DE | 693 04 882 T2 | 10/1996 |
| DE | 197 57 236 A1 | 6/1999 |
| DE | 199 38 523 A1 | 4/2000 |

* cited by examiner

*Primary Examiner*—Hwei-Siu Payer
(74) *Attorney, Agent, or Firm*—Lahive & Cockfield, LLP; Anthony A. Laurentano, Esq.

(57) ABSTRACT

A circular saw (1) includes a base (2) and a main body (3) mounted on the base and provided with an upper blade guard (7). Disposed behind the upper blade guard (7) is a stopper (22) which includes an upper curved portion (23) and an lower portion (24) coupled to the curved portion (23). One end of the lower portion (24) is attached to the main body (3) with a pivot screw (25) behind the blade guard (7) so as to permit the stopper to pivot on the screw (25) in parallel with a circular blade (5). Additionally, the curved portion (23) includes an arcuate guide slot (26). The stopper (22) further includes a fixing bolt (27) screwed in a boss (29) formed on the rear surface of the blade guard. The bolt (27) includes a lever (30) to be manually operated to selectively secure the curved portion to the bolt and release the curved portion therefrom. When the curved portion (23) is released, its pivotal position relative to the main body towards the base can be manually changed. Provided on the base is a projection (32) which is abutted by the stopper (22) when the main body (3) is lowered toward the base (2). When the curved portion (23) abuts the projection's upper surface (33), the amount of the blade (5) projecting below the base (i.e., the depth of cut) corresponds to the aforementioned relative position of the curved portion (23) with respect to the base (2).

20 Claims, 5 Drawing Sheets

CIRCULAR SAW WITH IMPROVED CUTTING DEPTH ADJUSTMENT

This application claims priority on Japanese Patent Application No. 2001-235411 filed on Aug. 2, 2001, the entire contents of which are incorporated herein by reference.

BACKGROUND OF THE INVENTION

1. Field of the Invention

The present invention generally relates to electric power tools. More particularly, the present invention relates to a disk-shaped saw having a base and a motor-driven circular blade mounted on the base.

2. Description of the Related Art

A typical circular saw includes a generally rectangular base and a main body mounted on the base. The main body in turn includes a motor-driven disk-shaped blade disposed generally on one side thereof and a motor housing encasing a motor disposed on the opposite side thereof. The forward end of the upper blade guard (adjacent to the cutting end of the saw blade) is coupled via a pivot shaft and a support member to the base in a manner that permits the blade guard to pivot about the shaft along the side faces of the blade. Furthermore, the rear end of the upper blade guard is coupled by a thumbscrew to an arcuate depth guide disposed on the base. The amount of the blade protruding below the base (i.e., the depth of cut) can be adjusted by securing the rear end of the main body to a desired position along the length of the depth guide.

Additionally, the support member and the depth guide are connected to the base with respective connecting shafts or pins oriented parallel to the saw blade in such a manner as to allow the support member and the depth guide to tilt relative to the base in the directions orthogonal to the blade's side faces. This in turn allows adjustment of the tilt angle of the saw blade protruding below the base.

While this arrangement achieves its intended objective, it is not free from certain problems and inconveniences. For example, in replacement of flooring, accurate settings of the depth of cut is required so as not to cut joists or concrete panels underneath the floor boards. Such settings are often performed by measuring with carpenters square the amount of the blade protruding below the base, rendering the task cumbersome, often producing inaccurate results. One conventional approach to this problem is to provide a scale on the depth guide or the upper blade guard. However, as such a scale merely indicates the position of the main body relative to the depth guide or the upper blade guard, this does solve the problem. This problem is particularly exacerbated in bevel cutting since accurate setting of the depth of cut becomes even more difficult with a tilted blade.

SUMMARY OF THE INVENTION

In view of the above-identified problems, an important object of the present invention is to provide a circular saw that realizes accurate adjustment of the depth of cut with a simple structure.

The above object and other related objects are realized by the invention, which provides a circular saw comprising: a generally rectangular base; a guide member disposed on the base; and a main body having forward and back ends, a motor, and a saw blade which is rotatably driven by the motor and has side faces, in which the forward end of the main body is coupled to the base so as to permit the main body to pivot along the side faces of the blade relative to the base, and the rear end of the main body is adapted such that it can be secured to any position along the guide member such that the amount of the blade protruding below the base can be changed by pivotally moving the main body and securing the rear end to any position along the guide member. In the circular saw, the main body includes a stopper whose position relative to the main body with respect to the base is changeable and which is brought into abutment with the base by the pivotal movement of the main body so as to limit the pivotal movement of the main body, such that the amount of the blade protruding below the base can be set by selection of the position of the stopper relative to the main body with respect to the base. This arrangement realizes easy and accurate setting of the depth of cut in workpieces.

According to one aspect of the present invention, the stopper is coupled to the main body so as to be pivotal on an axis toward the base, and the stopper includes securing means for securing the stopper to the main body at a desired pivotal position. This arrangement stabilizes the abutment of the stopper against the base and thus realizes more accurate settings of the depth of cut in workpieces.

According to another aspect of the present invention, the base includes on a top surface thereof a projection abutted by the stopper during the pivotal movement of the main body.

According to still another aspect of the present invention, the stopper includes a lower portion which has first and second ends, the first end of the lower portion being coupled to the main body via a pivot pin located on the axis of pivot, and an upper portion which is coupled to the second end of the lower portion and extends upwards in parallel to the side faces of the blade so as to form an approximately V-shape with the lower portion, whereas the securing means includes: an arcuate guide slot provided along a longitudinal center line in the upper portion such that the center of the circle which defines the longitudinal center line is located at the axis of the pivot pin; a boss provided on the main body; and a bolt including a head for threadably engaging the boss through the guide slot so as to grip the upper portion between the head and the boss against any movement of the stopper relative to the main body.

According to yet another aspect of the present invention, the upper portion is graduated and numbered on an outer edge thereof so as to represent the amount of the blade protruding below the base, and the main body is marked with a pointer disposed radially outside of the graduations so as to indicate a value on the graduations when the stopper is caused to pivot on the pin.

According to one feature of the present invention, the circular saw further comprises a pair of connecting pins having a common axis extending in parallel to the side faces of the blade, the connecting pins attaching the main body to the base such that the main body is tiltable within a predetermined range of angles about the common axis of the connecting pins in the two directions orthogonal to the side faces of the blade Additionally, the projection includes an upper abutment surface located in the locus of the pivotal movement of the stopper when the main body is tilted at a predetermined angle, with the upper abutment surface being inclined at an angle such that it comes into abutment with a bottom surface of the upper surface.

According to another feature of the present invention, the bolt further includes a lever connected to the head for manual tightening and loosening of the bolt in the boss.

According to still another feature of the present invention, the main body further includes: an upper blade guard provided on a front side of the circular saw for covering an upper portion of the blade; a motor housing provided on a rear side of the circular saw; and a handle disposed on the motor housing for operating the circular saw, with the stopper being disposed between the upper blade guard and the handle.

The present invention further provides a circular saw comprising: a base; a guide member disposed on the base, and a main body having forward and back ends, a motor, and a saw blade which is rotatably driven by the motor and has side faces, in which the forward end of the main body is coupled to the base so as to permit the main body to pivot along the side faces of the blade relative to the base, and the rear end of the main body is adapted such that it can be secured to any position along the guide member such that the amount of the blade protruding below the base can be changed by pivotally moving the main body and securing the rear end to any position along the guide member. In this tool, the main body includes a stopper extending toward the base, with the extension of the stopper relative to the main body toward the base being changeable and the stopper being brought into abutment with the base by the pivotal movement of the main body so as to limit the pivotal movement of the main body, such that the amount of the blade protruding below the base can be set by selection of the extension of the stopper relative to the main body toward the base.

In one aspect, the stopper is coupled to the main body so as to be pivotal on an axis toward the base, and the stopper includes securing means for securing the stopper to the main body at a desired pivotal position.

In another aspect of the present invention, the base includes on a top surface thereof a projection abutted by the stopper during the pivotal movement of the main body.

In still another aspect of the present invention, the stopper includes a lower portion which has first and second ends, the first end of the lower portion being coupled to the main body via a pivot pin located on the axis of pivot, and an upper portion which is coupled to the second end of the lower portion and extends upwards in parallel to the side faces of the blade so as to form an approximately V-shape with the lower portion, whereas the securing means includes: an arcuate guide slot provided along a longitudinal center line in the upper portion such that the center of the circle which defines the longitudinal center line is located at the axis of the pivot pin; a boss provided on the main body; and a bolt including a head for threadably engaging the boss through the guide slot so as to grip the upper portion between the head and the boss against any movement of the stopper relative to the main body.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment of the present invention will be described hereinafter with reference to the attached drawings.

Figure 1:
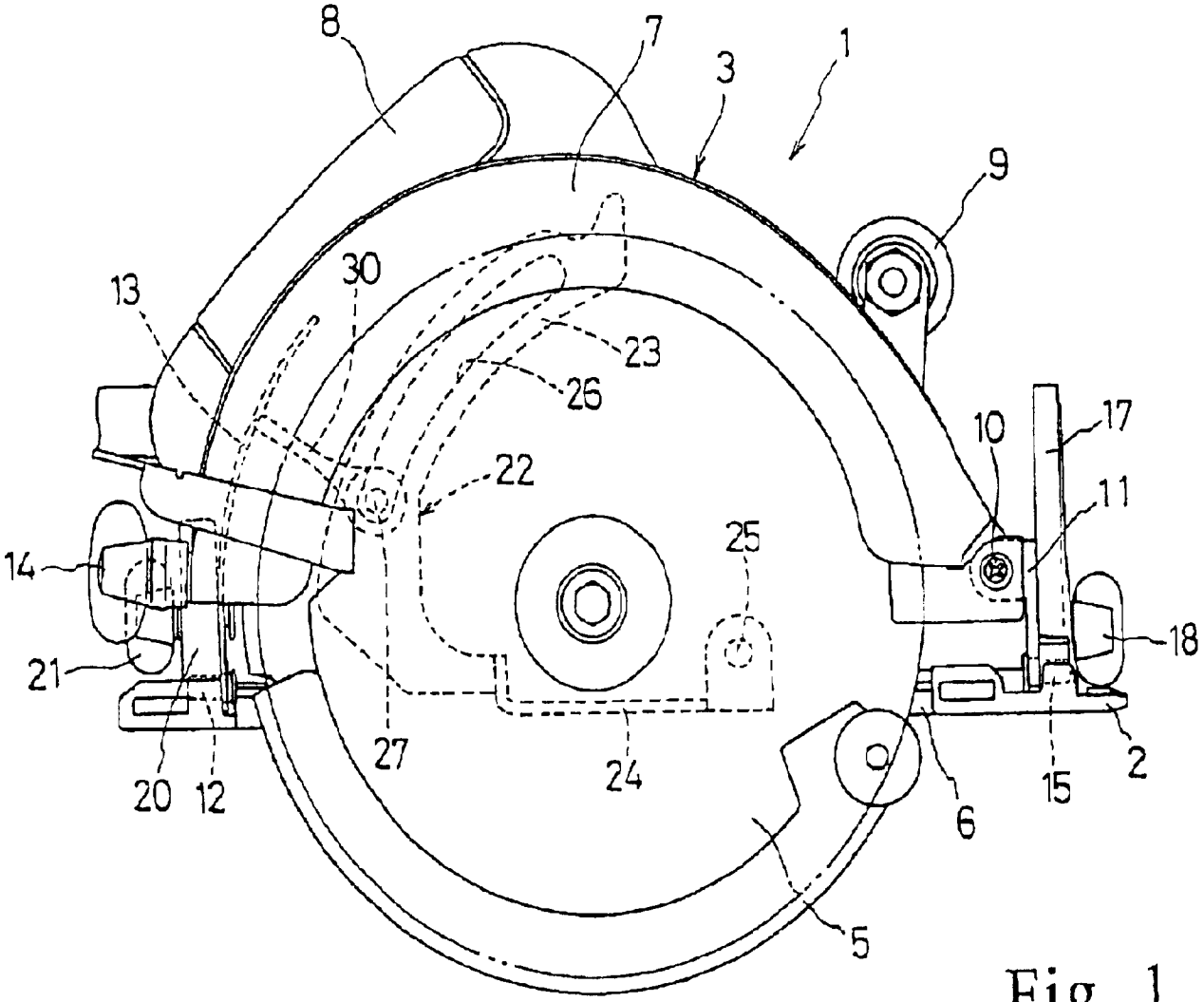
FIG. 1 is a front view of a corner-cutting circular saw 1 according to the present invention.
Figure 2:
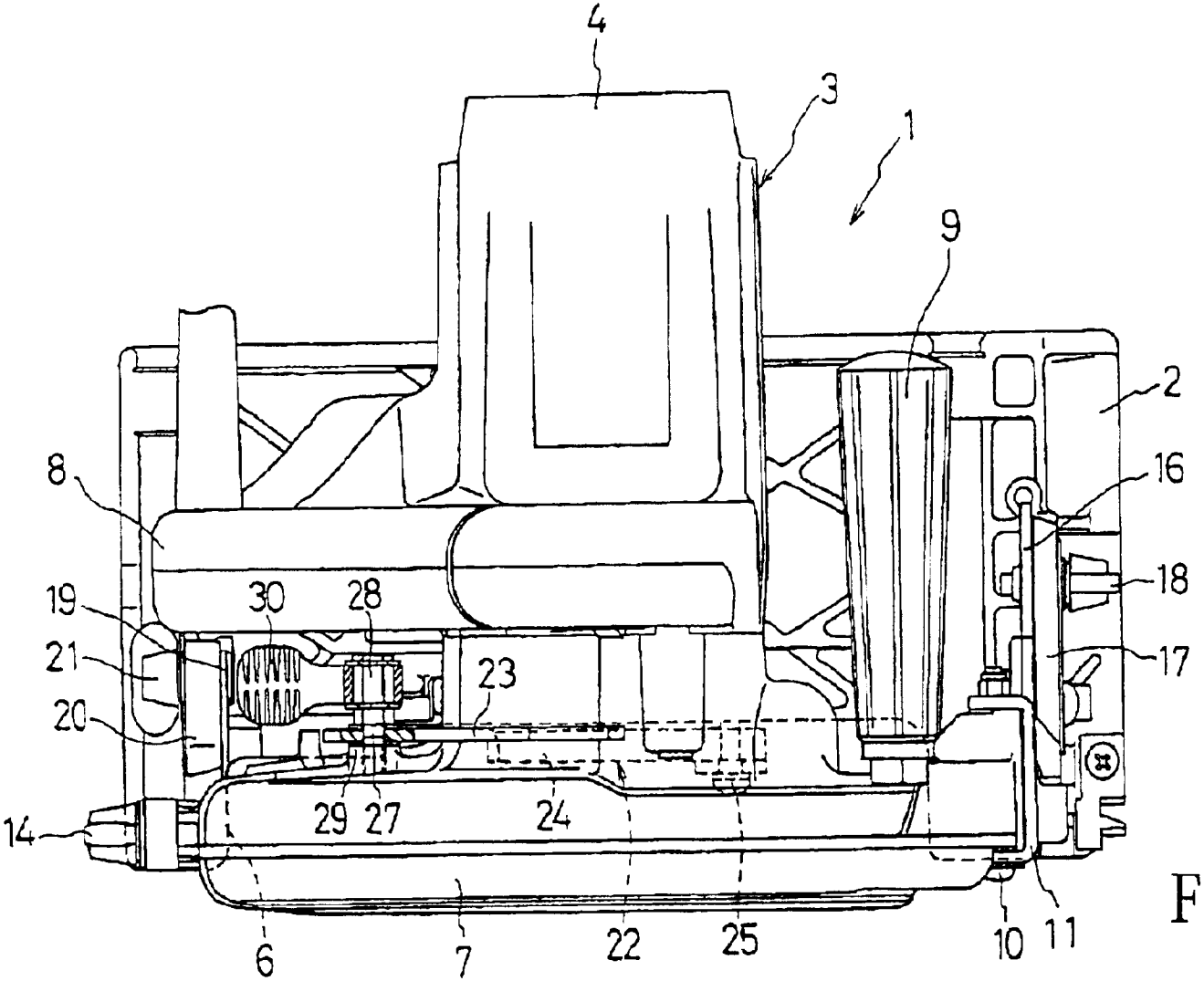
FIG. 2 is a plane view of the corner-cutting circular saw of FIG. 1.

FIG. 1 is a front view of a corner-cutting circular saw 1 according to the present invention and FIG. 2 is a plane view of the corner-cutting circular saw 1. The circular saw 1 includes a generally flat rectangular base 2 and a main body 3 mounted on the base 2. The main body 3 includes a circular or disk-shaped blade 5 disposed generally on the front side thereof and a motor housing 4 encasing a motor (not shown) disposed on the opposite rear side thereof. The saw blade 5 is coupled to and driven by the motor for cutting. The main body 3 is disposed on the base such that the saw blade 5 is oriented parallel with a longitudinal front edge of the base 2 and projects below the base 2 through a recess 6 formed in the longitudinal front edge of the base. The main body 3 further includes an upper blade guard 7 covering the upper portion of the saw blade 5 and a handle 8 for operating the circular saw 1 that extends from the motor housing 4 at a right angle to the housing's axis. Additionally included in the main body 3 is an auxiliary handle 9 projecting from the rear surface of the upper blade guard 7 at a right angle to the saw blade 5.

The right end (as viewed in FIGS. 1 and 2, i.e., in the direction in which cutting is to be made) of the upper blade guard 7 is coupled to a link 11 (which has a U-shape cross-section in its upper portion) by a bolt 10 in such a manner as to allow the blade guard 7 to pivot about the bolt 10 along the side faces of the blade 5. The bolt 10 extends through the U-shaped portion along the transverse edge of the base 2. Furthermore, the opposite end of the upper blade guard 7 is coupled to a depth guide 13 by a thumbscrew 14. In turn, the depth guide 13 is tiltably connected to the base 2 at its bottom end by a first pin 12 that extends in parallel to the longitudinal (front) edge of the base 2. Accordingly, the amount of the saw blade 5 protruding below the base 2 (i.e., the depth of cut) can be adjusted by loosening of the thumbscrew 14, causing the upper blade guard 7 to pivot to a desired vertical position along the depth guide 13, and retightening the thumbscrew 14 to tightly hold the guard 7 against any further movement with respect to the base 2.

Referring to FIGS. 1 and 3–5, the bottom of the link 11 (to which the upper blade guard 7 is coupled) is tiltably connected to the base 2 with a second pin 15 disposed coaxially with the first pin 12. Furthermore, an arm 16 extends from the bottom of the link 11 along the transverse edge of the base 2, reaching a guide plate 17 which is erected from the base 2 along the transverse edge of the base 2. The guide plate 17 includes an arcuate guide slot such that the center of the circle which forms the arcuate slot is located at the axis of the second pin 15. Another thumbscrew 18 is tightened into the free end of the arm 16 through the guide slot of the guide plate 17, thus securing the arm 16 to the guide plate 17. Referring to FIGS. 1 and 2, a guide arm 19 extends from the bottom surface of the depth guide 13 along the opposite transverse edge of the base 2. The guide arm 19 includes an arcuate guide slot with the center of the circle which forms the arcuate slot located at the axis of the first pin 12. The guide arm 19 is secured to an upright plate 20 provided on the base 2 by a thumbscrew 21. Accordingly, loosening of both thumbscrews 18 and 21 permits tilting of the main body 3 along with the link 11 and the depth guide 13 either to the front or rear direction about the first and second pins 12 and 15. By re-tightening the thumbscrews 18 and 21 after tilting the main body 3 and thus the saw blade 5 to a desired angular position, the blade 5 remains securely tilted at that angle with respect to the base 2.

Additionally, a stopper 22 is disposed behind the upper blade guard 7 as shown in FIGS. 1 (in broken lines) and 3 (in solid lines). As illustrated, the stopper 22 includes an upper curved portion 23 and an lower connecting portion 24 coupled to the bottom end of the curved portion 23 in such a manner as to generally form a reclined V-shape. A free end of the lower connecting portion 24 is attached to the main body 3 with a pivot screw 25 behind the upper blade guard 7 so as to permit the stopper 22 to pivot on the screw 25 along a plane extending parallel to the side faces of the saw blade 5. In addition, the upper curved portion 23 includes along its longitudinal central line an arcuate guide slot 26 such that the center of the circle which forms the arcuate slot 26 is located at the axis of the pivot screw 25. An appropriate fixing means, such as a fixing bolt 27, is tightened from behind into a boss 29 formed on the rear surface of the upper blade guard 7 through the guide slot 26 in order to prevent any movement of the stopper 22 relative to the blade guard 7.

Figure 3:
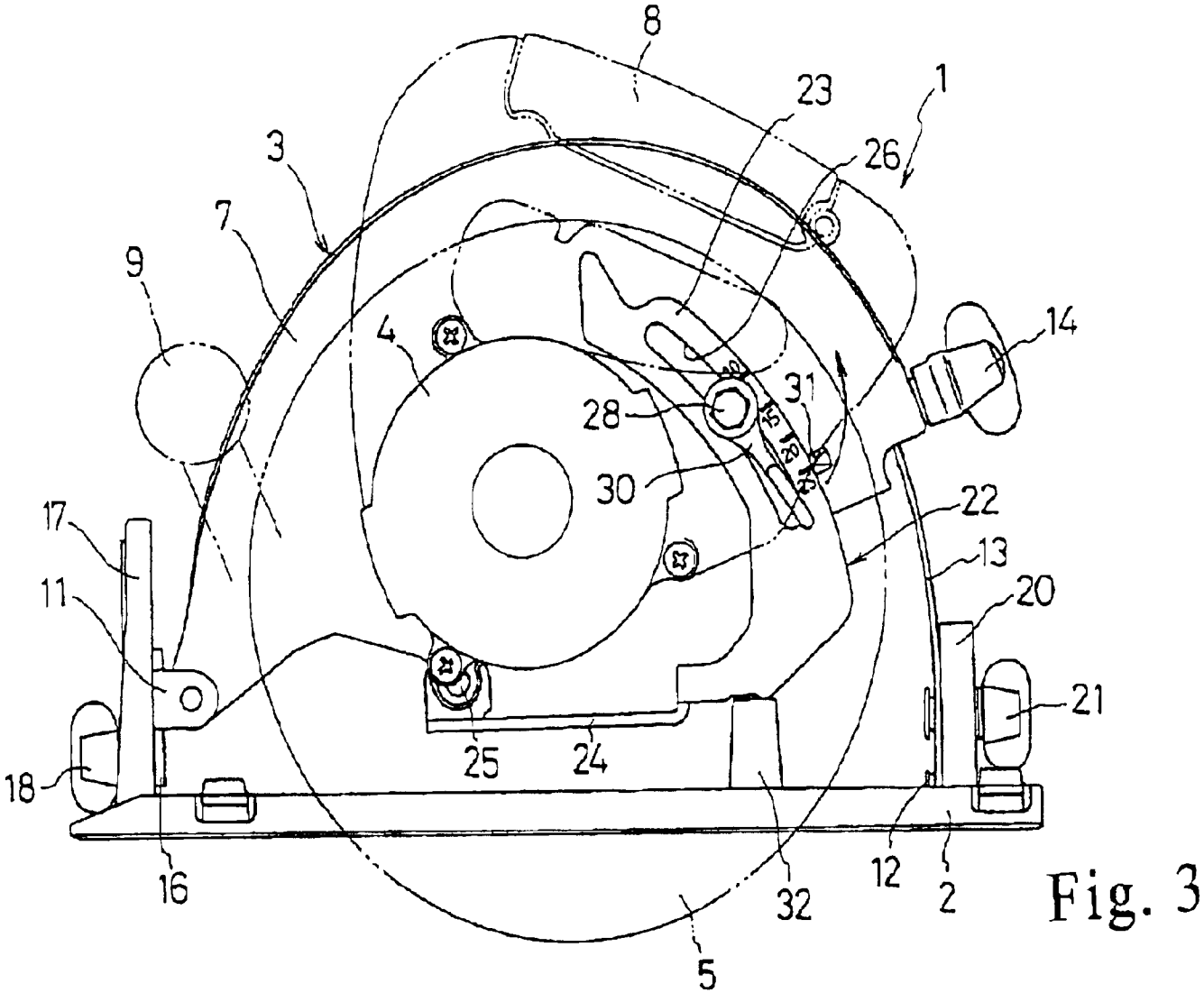
FIG. 3 is a rear view of the corner-cutting circular saw of FIG. 1.

As best shown in FIG. 3, the fixing bolt 27 includes a head 28 to which a fixing lever 30 is secured. When the fixing lever 30 is rotated clockwise (as viewed in FIG. 3), the fixing bolt 27 is tightened into the boss 29, thus firmly gripping the curved portion 23 between the bolt head 28 and the boss 29. Conversely, when the fixing lever 30 is rotated counterclockwise, the fixing bolt 27 is loosened to release the curved portion 23 from the grip between the bolt head 28 and the boss 29, thus allowing the stopper 22 to pivot on the screw 25. Accordingly, the position of the stopper 22 relative to the upper blade guard 7 with respect to the base 2 can be adjusted by selecting where the curved portion 23 is to be secured with the bolt 27 between the bolt head 28 and the boss 29. In other words, the extension or protrusion of the stopper 22 relative to the upper blade guard 7 toward the base 2 is changeable in this electric tool. Additionally, the curved portion 23 is graduated and numbered on its outer edge in a range from 10 to 25 mm in 5-mm increments. An arrowhead-shaped pointer 31 is marked on the rear surface of the upper blade guard 7 disposed radially outside of the scale on the curved portion 23 so as to indicate any point or value on the graduations.

Figure 4:
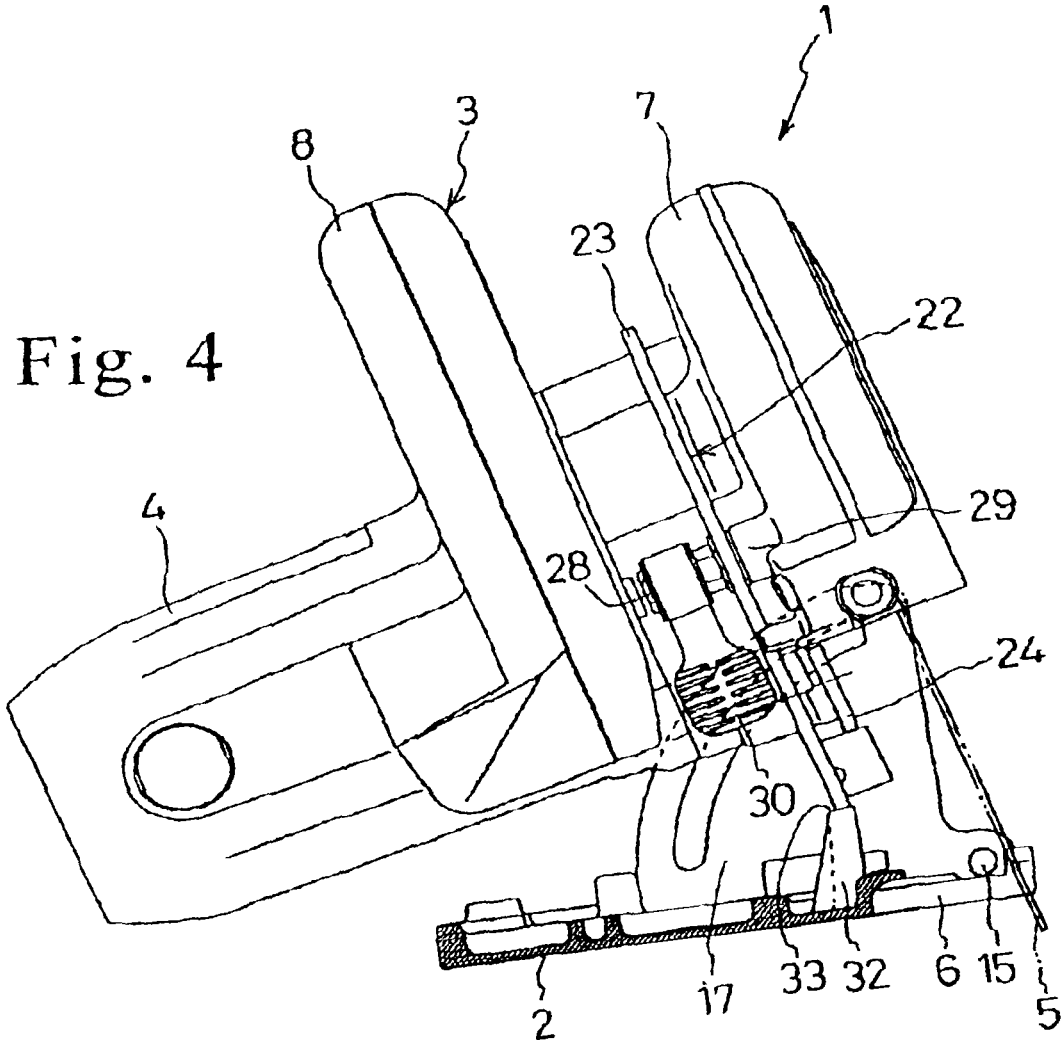
FIG. 4 is a side view of the corner-cutting circular saw of FIG. 1, with its main body tilted rearward 15 degrees.
Figure 5:
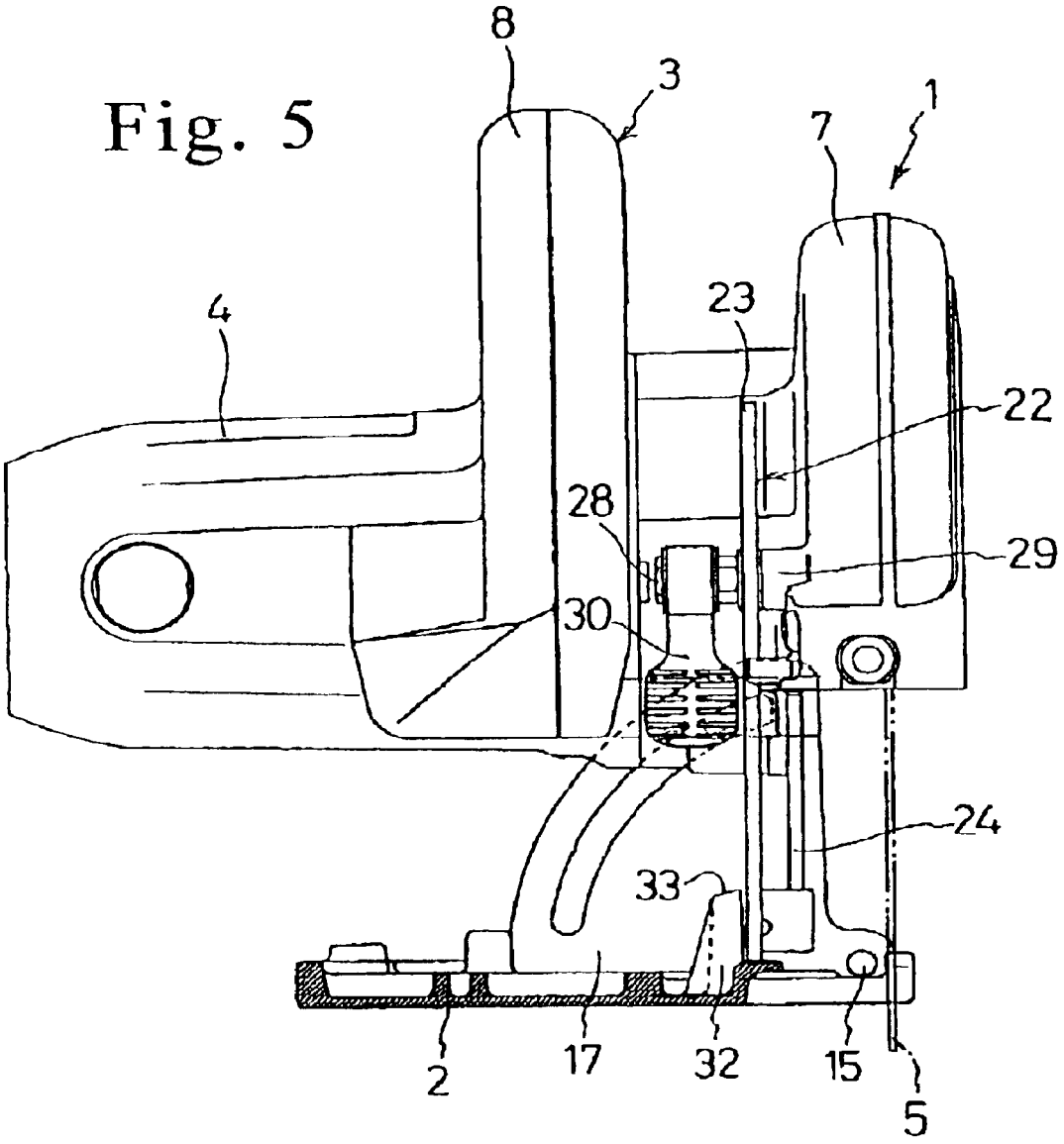
FIG. 5 is a side view of the corner-cutting circular saw of FIG. 1, with its main body in the upright position.

Referring to FIGS. 3–5, a projection 32 is provided on the top surface of the base 2. With specific reference to FIG. 4, the projection 32 includes an upper abutment surface 33 located in the locus of the movement of the curved portion 23 with the main body 3 (the saw blade 5) set at a rearward tilt angle of 15 degrees with respect to the base 2. When the main body 3 is pivotally lowered toward the base 2 at this tilt angle, the bottom surface of the curved portion 23 comes into abutment with the projection's upper surface 33. Accordingly, with the stopper 22 firmly coupled to the upper blade guard 7 with the bolt 27, the value at the pointer 31 indicates the amount of the saw blade 5 projecting below the base 2 (as measured orthogonally with respect to the base, i.e., the depth of cut) when the bottom surface of the curved portion 23 is in abutment with the projection's upper surface 33. As also illustrated in FIGS. 4 and 5, the upper surface 33 of the projection 32 is inclined at an angle such that it comes into abutment with a bottom surface of the curved portion 23.

In a corner cutting circular saw 1 thus constructed, when the thumbscrews 18 and 21 are loosened and the main body 3 is tilted about the first and second pins 12 and 15 toward the front, the lower portion of the saw blade 5 protruding below the base 2 moves toward the rear. When these thumbscrews 18 and 21 are tightened again, bevel cuts can be made. Conversely, as shown in FIG. 4, when the main body 3 is tilted about the pins 12 and 15 toward the rear, the upper blade guard 7 also pivots to the rear on the two pins, moving the lower portion of the saw blade 5 below the base 2 toward the front. This permits abutment of the base's front edge against a wall or other structure in order to perform cutting in the workpiece along the corner formed between the wall and the workpiece.

To adjust the depth of cut, the thumbscrew 14 is first loosened and then the fixing lever 30 is [first] rotated upward to loosen the lever 30. The stopper 22, now released from the grip between the bolt head 28 and the boss 29, is rotated until the desired value on the depth scale is set at the pointer 31. Thereupon, the bolt 27 is re-tightened by downward rotation of the fixing lever 30, thus gripping the stopper 22 between the bolt head 28 and the boss 29 and firmly connecting the curved portion 23 of the stopper 22 to the upper blade guard 7. Next, [the thumbscrew 14 is loosened and] the main body 3 is pivotally lowered towards the base 2 until the curved portion 23 of the stopper 22 comes into abutment with the projection 32, prohibiting any further pivotal movement of the main body 3. Thereupon, when the main body 3 is secured against any movement relative to the base 2 by tightening of the thumbscrew 14, the saw blade 5 is fixed with the selected depth of cut.

As described above, the corner cutting circular saw 1 of the present invention includes in the main body 3 a stopper 22 whose position relative to the blade guard 7 with respect to the base 2 can be changed. The saw 1 additionally includes on the base 2 a projection 32 with which the stopper 22 comes into abutment during its rotation to limit the pivotal movement of the stopper 22. According to this arrangement, the amount of the saw blade 5 protruding below the base 2 can be set by selecting the position of the stopper 22 relative to the blade guard 7 with respect to the base 2. This permits easy and accurate setting of the depth of cut even when the main body 3 is tilted (i.e., by adjusting the extension or protrusion of the stopper 22 relative to the blade guard 7 toward the base 2).

As also described above, the stopper 22 is a rotatable or pivotal member that includes a fixing means to secure the stopper to the upper blade guard 7 at a desired pivotal position towards the base 2. This stabilizes the abutment of the stopper against the projection 32 and thus realizes highly accurate settings of the depth of cut in workpieces.

It should be noted that the foregoing embodiment effectively utilizes the otherwise empty space behind the upper blade guard 7 to accommodate and allow the stopper 22 to pivot along the saw blade 5 without any interference with other parts or mechanisms of the circular saw 1.

As shown in FIG. 5, the projection 32 is positioned on the base 2 so as not to interfere with the stopper 22 when the main body 3 is not tilted (i.e., the saw blade 5 is oriented vertically for vertical cutting). It should be noted, however, that the stopper 22 can be reshaped and dimensioned in such a manner as to interfere with the stopper 22 when vertical cuts are made in workpieces. Moreover, the same or similar effect may be obtained without the projection 32 of the foregoing embodiment. For example, the depth of cut may be set on the basis of the position of the stopper 22 where it abuts the upper surface of the base 2. This is also applicable to the setting of the depth of cut when the main body 3 is tilted 45 degrees to the front as well as when the main body 3 is held upright in order to perform vertical cuts.

Additionally, the stopper 22 need not be a pivotal or rotatable member as in the foregoing embodiment Instead, it may be formed in a plate or bar adapted so as to be slidable along a straight line insofar as its relative position to the base is adjustable.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

1. A circular saw comprising:

a generally rectangular base;

a guide member disposed on the base; and a main body having forward and back ends, a motor, and a saw blade which is rotatably driven by the motor and has side faces, wherein the forward end of the main body is coupled to the base so as to permit the main body to pivot along the side faces of the blade relative to the base, and the rear end of the main body is adapted such that it can be secured to any position along the guide member such that the amount of the blade protruding below the base can be changed by pivotally moving the main body and securing the rear end to any position along the guide member, wherein the main body includes a stopper whose position relative to the main body with respect to the base is changeable and which is brought into abutment with the base by the pivotal movement of the main body so as to limit the pivotal movement of the main body, such that the amount of the blade protruding below the base can be set by selection of the position of the stopper relative to the main body with respect to the base.

2. A circular saw in accordance with claim 1, wherein the stopper is coupled to the main body so as to be pivotal on an axis toward the base, and further wherein the stopper includes securing means for securing the stopper to the main body at a desired pivotal position.

3. A circular saw in accordance with claim 2, wherein the base includes on a top surface thereof a projection abutted by the stopper during the pivotal movement of the main body.

4. A circular saw in accordance with claim 2, wherein the stopper includes a lower portion which has first and second ends, the first end of the lower portion being coupled to the main body via a pivot pin located on the axis of pivot, and an upper portion which is coupled to the second end of the lower portion and extends upwards in parallel to the side faces of the blade so as to form an approximately V-shape with the lower portion, and further wherein the securing means includes an arcuate guide slot provided along a longitudinal center line in the upper portion such that the center of the circle which defines the longitudinal center line is located at the axis of the pivot pin, a boss provided on the main body, and a bolt including a head for threadably engaging the boss through the guide slot so as to grip the upper portion between the head and the boss against any movement of the stopper relative to the main body.

5. A circular saw in accordance with claim 4, wherein the upper portion is graduated and numbered on an outer edge thereof so as to represent the amount of the blade protruding below the base, and the main body is marked with a pointer disposed radially outside of the graduations so as to indicate a value on the graduations when the stopper is caused to pivot on the pin.

6. A circular saw in accordance with claim 4, wherein the bolt further includes a lever connected to the head for manual tightening and loosening of the bolt in the boss.

7. A circular saw in accordance with claim 4, wherein the main body further includes an upper blade guard on a front side of the circular saw for covering an upper portion of the blade, a motor housing on a rear side of the circular saw, and a handle disposed on the motor housing for operating the circular saw, the stopper and a projection being disposed between the blade guard and the handle.

8. A circular saw in accordance with claim 1, wherein the base includes on a top surface thereof a projection abutted by the stopper during the pivotal movement of the main body.

9. A circular saw in accordance with claim 8 further comprising a pair of connecting pins having a common axis extending in parallel to the side faces of the blade, the connecting pins attaching the main body to the base such that the main body is tiltable within a predetermined range of angles about the common axis of the connecting pins in the two directions orthogonal to the side faces of the blade, wherein the projection includes an upper abutment surface located in the locus of the pivotal movement of the stopper when the main body is tilted at a predetermined angle, the upper abutment surface being inclined at an angle such that it conies into abutment with a bottom surface of the upper abutment surface.

10. A circular saw in accordance with claim 1, wherein the main body further includes an upper blade guard provided on a front side of the circular saw for covering an upper portion of the blade, a motor housing provided on a rear side of the circular saw, and a handle disposed on the motor housing for operating the circular saw, the stopper being disposed between the upper blade guard and the handle.

11. A circular saw comprising:

a base;

a guide member disposed on the base; and a main body having forward and back ends, a motor, and a saw blade which is rotatably driven by the motor and has side faces, wherein the forward end of the main body is coupled to the base so as to permit the main body to pivot along the side faces of the blade relative to the base, and the rear end of the main body is adapted such that it can be secured to any position along the guide member such that the amount of the blade protruding below the base can be changed by pivotally moving the main body and securing the rear end to any position along the guide member, wherein the main body includes a stopper extending toward the base, the extension of the stopper relative to the main body toward the base being changeable and the stopper being brought into abutment with the base by the pivotal movement of the main body so as to limit the pivotal movement of the maim body, such that the amount of the blade protruding below the base can be set by selection of the extension of the stopper relative to the main body toward the base.

12. A circular saw in accordance with claim 11, wherein the stopper is coupled to the main body so as to be pivotal on an axis toward the base, and further wherein the stopper includes securing means for securing the stopper to the main body at a desired pivotal position.

13. A circular saw in accordance with claim 12, wherein the base includes on a top surface thereof a projection abutted by the stopper during the pivotal movement of the main body.

14. A circular saw in accordance with claim 12, wherein the stopper includes a lower portion which has first and second ends, the first end of the lower portion being coupled to the main body via a pivot pin located on the axis of pivot, and an upper portion which is coupled to the second end of the lower portion and extends upwards in parallel to the side faces of the blade so as to form an approximately Y-shape with the lower portion, and further wherein the securing means includes an arcuate guide slot provided along a longitudinal center line in the upper portion such that the center of the circle which defines the longitudinal center line is located at the axis of the pivot pin, a boss provided on the main body, and a bolt including a head for threadably engaging the boss through the guide slot so as to grip the upper portion between the head and the boss against any movement of the stopper relative to the main body.

15. A circular saw in accordance with claim 14, wherein the upper portion is graduated and numbered on an outer edge thereof so as to represent the amount of the blade protruding below the base, and the main body is marked with a pointer disposed radially outside of the graduations so as to indicate a value on the graduations when the stopper is caused to pivot on the pin.

16. A circular saw in accordance with claim 14, wherein the bolt further includes a lever connected to the head for manual tightening and loosening of the bolt in the boss.

17. A circular saw in accordance with claim 14, wherein the main body further includes an upper blade guard on a front side of the circular saw for covering an upper portion of the blade, a motor housing on a rear side of the circular saw, and a handle disposed on the motor housing for operating the circular saw, the stopper and a projection being disposed between the blade guard and the handle.

18. A circular saw in accordance with claim 11, wherein the base includes on a top surface thereof a projection abutted by the stopper during the pivotal movement of the main body.

19. A circular saw in accordance with claim 18 further comprising a pair of connecting pins having a common axis extending in parallel to the side faces of the blade, the connecting pins attaching title main body to the base such that the main body is tillable within a predetermined range of angles about the common axis of the connecting pins in the two directions orthogonal to the side faces of the blade, wherein the projection includes an upper abutment surface located in the locus of the pivotal movement of the stopper when the main body is tilted at a predetermined angle, the upper abutment surface being inclined at an angle such that it comes into abutment with a bottom surface of the upper abutment surface.

20. A circular saw in accordance with claim 11, wherein the main body further includes an upper blade guard provided on a front side of the circular saw for covering an upper portion of the blade, a motor housing provided on a rear side of the circular saw, and a handle disposed on the motor housing for operating the circular saw, the stopper being disposed between the upper blade guard and the handle.

* * * * *